United States Patent [19]

Pelczar

[11] 4,028,970

[45] June 14, 1977

[54] ADJUSTABLE WRENCH

[76] Inventor: Stanley J. Pelczar, 131 Green Manor Drive, East Hartford, Conn. 06118

[22] Filed: Feb. 9, 1976

[21] Appl. No.: 656,120

[52] U.S. Cl. ..... 81/165; 81/170

[51] Int. Cl.[2] ..... B25B 13/16

[58] Field of Search ..... 81/129, 165, 170, 172

[56] References Cited

UNITED STATES PATENTS

| | | | |
|---|---|---|---|
| 1,196,393 | 8/1916 | Parmer | 81/165 |
| 2,646,710 | 7/1953 | Allen | 81/165 |
| 2,708,386 | 5/1955 | Ellis, Jr. et al. | 81/165 |
| 3,368,432 | 2/1968 | Halls | 81/165 |
| 3,376,766 | 4/1968 | Vienat | 81/129 X |
| 3,555,939 | 1/1971 | Halls | 81/172 X |
| 3,901,107 | 8/1975 | Halls | 81/165 X |

*Primary Examiner*—Al Lawrence Smith
*Assistant Examiner*—James G. Smith

[57] ABSTRACT

An adjustable open end wrench is presented, the wrench having a thumb operated pulley in the handle, a worm gear drivingly connected to an adjustable jaw in the head, and a drive belt running between the thumb pulley and the worm gear.

5 Claims, 3 Drawing Figures

ADJUSTABLE WRENCH

BACKGROUND OF THE INVENTION

This invention relates to the field of hand wrenches. More particularly, this invention relates to the field of adjustable wrenches.

Adjustable wrenches, particularly of the open end variety, have been known in the art for many years. Typically, these wrenches have relatively movable jaw elements, and the jaws are adjustable by a screw or similar element in the head of the wrench. Adjustment is effected by manual operation of the screw or other similar adjusting element. There are, however, many situations in which adjustment of these typical wrenches is either inconvenient or impossible to accomplish in a speedy and efficient manner. For example, the wrench may be in use in close quarters where the user cannot insert his fingers to operate the adjusting element. In situations of this type adjustment can only be effected by removing the wrench from the element being worked on, estimating the adjustment to be made, and then reinserting the wrench. If the adjustment is not correct, this process must be repeated by trial and error until the correct adjustment is effected.

SUMMARY OF THE INVENTION

The adjustable wrench of the present invention overcomes the above discussed and other deficiencies of the prior art and results in a wrench which is extremely convenient to use and relatively inexpensive to manufacture. A particularly significant feature of the wrench of the present invention is that it can be operated from the handle end of the wrench, i.e. that part of the wrench which is normally grasped by the user's hand when operating the wrench. Thus, the wrench can be adjusted by the user with his hand on the handle, and there is no need to remove the wrench from an installation or change the position of the wrench in the hands of the user to effect the desired adjustment.

In its basic configuration the wrench of the present invention has an adjustable jaw in the head with a worm gear threadably connected to the adjustable jaw. A thumb operated pulley is mounted in the handle of the wrench, and the worm gear and pulley are interconnected by a drive belt. Adjustment of the jaw is effected merely by movement of the thumb pulley which is transmitted via the drive belt to the worm gear to move the jaw.

Accordingly, one object of the present invention is to provide a novel and improved adjustable wrench.

Another object of the present invention is to provide a novel and improved adjustable wrench which is easy and convenient to operate.

Still another object of the present invention is to provide a novel and improved adjustable wrench in which an adjustable jaw in the head of the wrench can be operated from the handle of the wrench.

Other objects and advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
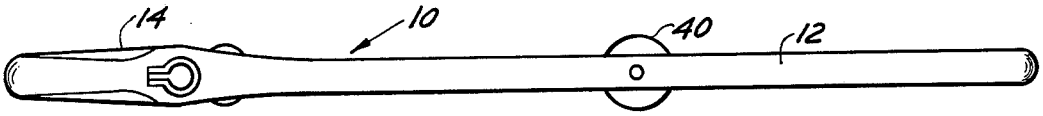
FIG. 1 is a side elevation view of the adjustable wrench of the present invention.
Figure 2:
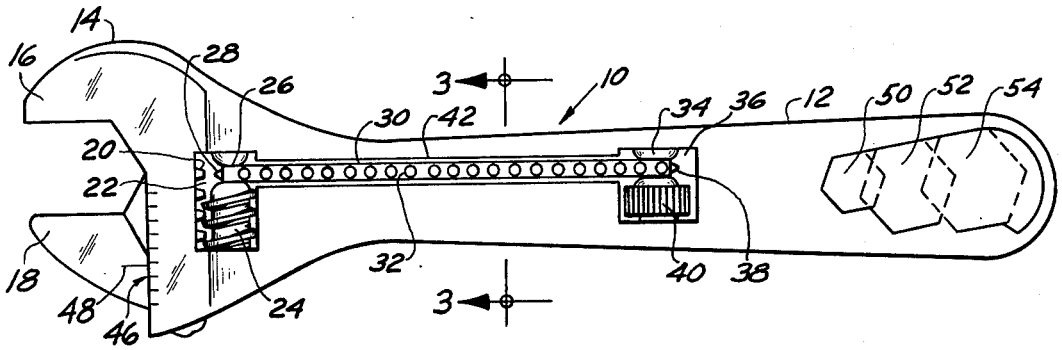
FIG. 2 is a view looking down on FIG. 1 showing the wrench in a top plan view.
Figure 3:
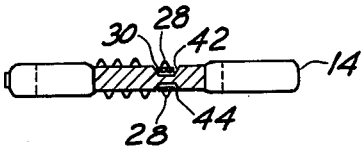
FIG. 3 is a view taken along line 3—3 of FIG. 2.

Referring jointly to FIGS. 1, 2 and 3, the wrench 10 has a handle segment 12 and a head segment 14. Head 14 has a stationary jaw 16 and a movable jaw 18 so that the opening in the head of the wrench can be adjusted to accommodate various sizes of fastening elements by movement of jaw 18 relative to jaw 16. A toothed rack 20 projects from the bottom of movable jaw 18, the teeth of the rack projecting into a rectangularly shaped opening or recess 22 in the head of the wrench. A helical worm element 24 is rotatably mounted in opening 22, with the helical threads of the worm being in driving engagement with the teeth of rack 20. A reduced diameter section 26 of worm 24 near one end of the worm has an array of radially extending conical projections 28 (only one of which can be seen in FIG. 2 and two of which can be seen in FIG. 3) equally spaced around the worm; said projections 28 defining a first sprocket wheel. A continuous drive belt 30 has perforations 32 distributed about the belt, the perforations being equally spaced. Belt 30 wraps around the reduced diameter section 26 of the worm, and perforations 32 are engaged by projections 28 on the worm. The other end of continuous belt 30 loops around a drive pulley 34 which is rotatably mounted in a rectangular opening or recess 36 in handle segment 12. Pulley 34 has projections 38 (only one of which can be seen in FIG. 2) extending from a reduced diameter section of the pulley to define a second sprocket wheel, the projections 38 being equidistantly spaced about the pulley. Projections 38 also engage perforations 32 in drive belt 30, so that there is a continuous driving connection between pulley 36 and worm 24 via endless belt 30. A knurled wheel 40, which is integral with pulley 34, is positioned in opening 36 and projects beyond the sides of handle 12 to be grasped by the fingers of a user for purposes of adjusting the wrench.

Belt 30 may be of any suitable strong material which can form a continuous loop around the pulley and the worm to transmit forces therebetween. A thin steel band is preferable for belt 30, but other suitable materials will be readily apparent. Recesses 42 and 44 extend between opening 36 and opening 22 on opposite sides of handle 12, and belt 30 is housed in recesses 42 and 44 so that the belt is below the surfaces of the wrench handle and is, therefore, protected against impact or other interference with machinery or any other article in which the wrench might be used.

In the operation of the wrench, the head of the wrench may be placed on a fastener, such as a nut, which is to be loosened or tightened. If the spacing between jaws 16 and 18 is incorrect, the adjustment can be effected merely by finger action of the user to rotate wheel 40 in the appropriate direction to either enlarge or close the opening between jaws 16 and 18. Rotation of wheel 40 and pulley 34 results in movement of belt 30 which, in turn, rotates worm 24 to drive rack 20 to change the position of adjustable jaw 18.

As a feature of particular convenience, a scale, which may be either in English or Metric measure, is incorporated in the head of the wrench to indicate the setting of the jaw opening. Scale markings 46 are located on a fixed part of the head, and an alignment groove or marking 48 is located on jaw 18. The setting of the wrench, and hence the nominal size of the opening of the jaws, can be determined merely by observing the position of line 48 relative to scale 46.

As an added convenience feature, a series of openings of different sizes, 50, 52 and 54 may be provided in handle 12 to constitute a series of box end wrenches of different sizes. It will, however, be understood that this feature is merely a feature of added convenience and does not affect the operation of the adjustable head wrench.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An adjustable jaw wrench comprising:

body means, said body means including an integral handle and a head portion, said head portion defining a stationary jaw;

a movable jaw reciprocally mounted in said body means head portion in alignment with said stationary jaw, said movable jaw including a rack;

driven means mounted in said body means head portion, said driven means being operably connected to said movable jaw and causing movement of said movable jaw relative to said stationary jaw, said driven means including:

a worm gear rotatably mounted in said body means head, said worm gear engaging said movable jaw rack; and first sprocket means integral with said worm gear, said first sprocket means being rotatable with said worm gear and including a plurality of outwardly extending projections, said first sprocket means and at least a portion of said worm gear being positioned in an aperture in said body means head portion whereby said first first sprocket means is accessible from opposite sides of said body means;

drive means mounted in said body means handle, said drive means comprising:

second sprocket means rotatably mounted in said handle, said second sprocket means including a plurality of outwardly extending projections;

a thumb wheel coupled to said second sprocket means for causing rotation thereof, said thumb wheel and a portion of said second sprocket means being positioned in an aperture in said body means handle, said thumb wheel extending outwardly from said opposite sides of said body means handle, access to said second sprocket means being afforded from said opposite sides of said body means; and an endless drive belt, said drive belt being perforated and extending between said first and second sprocket means, said drive belt perforations being engaged by said sprocket means projections.

2. An adjustable wrench as in claim 1 including:

scale means between said head and said movable jaw means to indicate the size of the opening between said movable jaw means and said fixed jaw.

3. An adjustable wrench as in claim 1 wherein said body means handle and head portion define a recess extending between said apertures in alignment with said first and second sprockets, said perforated endless belt being positioned in said recess.

4. An adjustable wrench as in claim 1 wherein said body means handle and head portions define a pair of recesses at opposite sides of said body means, said recesses being parallel and extending between said apertures in alignment with said first and second sprockets, said perforated endless belt traveling in said recesses.

5. An adjustable wrench as in claim 4 including:

scale means between said head and said movable jaw means to indicate the size of the opening between said movable jaw means and said fixed jaw.

* * * * *